US008973700B2

(12) United States Patent
Spieth et al.

(10) Patent No.: US 8,973,700 B2
(45) Date of Patent: Mar. 10, 2015

(54) EXHAUST SYSTEM COMPONENT

(75) Inventors: Arnulf Spieth, Hochdorf (DE); Georg Wirth, Kirchheim/Teck (DE)

(73) Assignee: Eberspaecher Exhaust Technology GmbH & Co. KG, Neunkirchen (DE)

( * ) Notice: Subject to any disclaimer, the term of this patent is extended or adjusted under 35 U.S.C. 154(b) by 467 days.

(21) Appl. No.: 13/410,415

(22) Filed: Mar. 2, 2012

(65) Prior Publication Data

US 2012/0223210 A1 Sep. 6, 2012

(30) Foreign Application Priority Data

Mar. 4, 2011 (DE) ..... 10 2011 005 155

(51) Int. Cl.
*B60K 13/04* (2006.01)
*F01N 13/18* (2010.01)
*F01N 13/00* (2010.01)

(52) U.S. Cl.
CPC ..... *F01N 13/18* (2013.01); *F01N 13/00* (2013.01); *F01N 13/1811* (2013.01)
USPC ..... 180/309

(58) Field of Classification Search
USPC ..... 180/390, 68.5; 138/118.1, 124, 138/133–134; 429/34; 181/241, 34, 263
See application file for complete search history.

(56) References Cited

U.S. PATENT DOCUMENTS 5,687,697 A * 11/1997 Ishikawa ..... 123/520
5,956,950 A * 9/1999 Gensert et al. ..... 60/322
6,726,884 B1 * 4/2004 Dillon et al. ..... 422/179
6,935,461 B2 * 8/2005 Marocco ..... 181/270
7,992,677 B2 * 8/2011 Kadandale ..... 181/282
8,388,896 B2 * 3/2013 Lehnen et al. ..... 422/168
8,434,590 B2 * 5/2013 Keck ..... 181/228
8,652,599 B2 * 2/2014 Braunreiter et al. ..... 428/34.5

FOREIGN PATENT DOCUMENTS

DE 3612515 A1 10/1987
DE 43 23 644 A1 1/1995
DE 10 2004 035 495 A1 2/2006
DE 102005009749 A1 9/2006
DE 20 2006 011 238 U1 12/2007
FR 2 819 013 A1 7/2002

* cited by examiner

*Primary Examiner* — John Walters
*Assistant Examiner* — James Triggs
(74) *Attorney, Agent, or Firm* — Reinhart Boerner Van Deuren P.C.

(57) ABSTRACT

The present invention relates to an exhaust system component (1) for an exhaust system of a combustion engine, in particular of a motor vehicle, with a housing (2) having at least one housing wall (4), which separates an interior space (5) of the housing (2) exposed to an internal pressure (Pi) during the operation of the exhaust system from a surroundings (6) surrounding the housing (2) and having an ambient pressure (Pu).

In order to improve the durability of the component (1) even with small wall thicknesses, at least one stiffening element (3) can be provided, which is fastened to and arranged on the housing (2) such that it counteracts an internal pressure (Pi) that is above the ambient pressure (Pu) induced by the deformation of the housing wall (4).

12 Claims, 4 Drawing Sheets

EXHAUST SYSTEM COMPONENT

CROSS-REFERENCE TO RELATED PATENT APPLICATIONS

This patent application claims priority to German Application No. 102011005155.4, filed Mar. 4, 2011, the entire teachings and disclosure of which are incorporated herein by reference thereto.

FIELD OF THE INVENTION

The present invention relates to an exhaust system component for an exhaust system of a combustion engine, in particular of a motor vehicle.

BACKGROUND OF THE INVENTION

Conventional exhaust system components such as for example silencers, particle filters, catalytic converters, SCR-systems and the like, usually comprise a housing having at least one housing wall, which separates an interior space of the housing exposed to an internal pressure during the operation of the exhaust system from a surroundings having an ambient pressure surrounding the housing. Here, the internal pressure is usually greater than the ambient pressure, so that the respective housing wall is exposed to a pressure force orientated to the outside. In order to reduce the fuel consumption in motor vehicles, attempts are made among other things to save as much weight as possible. With respect to exhaust system components, this means that the housings are to be produced with smaller wall thicknesses. However, thinner housing walls can be more greatly deformed because of the previously mentioned pressure forces that occur. Such deformations can result in a noise development at an appropriate frequency. On the other hand, connecting points such as for example weld seams in particular are exposed to very high mechanical loads through such deformations. Thus, deformations of this type induced by the internal pressure can impair the lifespan of the respective exhaust system component.

The present invention deals with the problem of stating an improved embodiment for an exhaust system component of the type mentioned at the outset, which is characterized in particular in that it is suited in a special way for realising a light-weight construction embodiment. In particular the lifespan is to be increased and/or the noise emission reduced.

SUMMARY OF THE INVENTION

According to the invention, this problem is solved through the subject of the independent claim. Advantageous embodiments are the subject of the dependent claims.

The invention is based on the general idea of equipping the housing with at least one stiffening element, wherein the respective stiffening element is so arranged and configured that it counteracts a deformation of the housing wall exposed to the internal pressure. With the help of the respective stiffening element, the housing on the one hand can be stiffened in such a manner that a deformation tendency of the housing wall concerned is reduced. On the other hand, the housing wall affected by the deformation can itself be stiffened through the respective stiffening element. Practically, the respective stiffening element is a component that is separate with respect to the respective housing wall, which is attached to the housing. Alternatively it is likewise possible in principle to integrate the respective stiffening element in the respective housing wall, for example by producing the respective housing wall from a so-called tailored blank. It is clear that the respective stiffening element has a clearly smaller area than the housing wall, so that altogether the desired weight saving can be realised. By using at least one such stiffening element, the stability of the housing can be achieved with the help of the respective stiffening element, while the gas tightness of the housing is realised with the help of the respective housing wall. Insofar, a functional separation can be quasi realised, so that the housing wall is relieved of its supporting function within the housing through the use of the respective stiffening element to a greater or lesser degree.

According to an advantageous embodiment, the respective stiffening element can be configured rod-shaped or web-shaped or wire-shaped or band-shaped. Such a linear stiffening element can in particular be continuously provided on coils, windings and the like and is characterized by an extremely high tensile strength with small installation space. Thus, the respective housing wall can be stiffened in a linear shape. Particularly practically, the respective stiffening element is a tension-stable tensile element such as for example a wire or a band or a cable.

According to another embodiment, the respective tensile element can be arranged on an outside of the respective housing wall facing the surroundings. In this manner, forces orientated towards the outside can be particularly easily converted into tensile forces on the respective tensile element, which can be received and absorbed in a particularly simple manner by the respective tensile element. Practically, the respective tensile element can only be fastened to the housing in the region of its longitudinal ends, so that the respective tensile element absorbs the pressure forces between its ends and supports these in the form of tensile forces on the housing. As an alternative to this, the respective tensile element can also be configured annularly closed in a circular manner, so that the tensile forces can be completely absorbed within the respective tensile element. It can be provided, in addition, that the respective tensile element, in particular between its longitudinal ends, loosely comes to bear in a deformation region of the respective housing wall affected by the pressure-induced deformation. Because of this, relative movements between housing wall and tensile element are possible in particular in order to avoid mechanical stresses.

According to another advantageous embodiment, at least one holder or a holding frame can be arranged on the housing on an outside facing the surroundings outside a deformation region of the respective housing wall affected by the pressure-induced deformation, on which the respective tensile element is supported. Thus, the fixing or supporting of the respective tensile element is not affected on the housing, but via said holder or holding frame. Thus, the force introduction from the respective tensile element into the housing can be improved via the holder or holding frame specially configured for this purpose.

According to another embodiment, at least one such stiffening element can be configured as pressure-stable pressure element. Such a pressure element can for example be a profile member with any profile cross section in principle. For example, closed profiles or hollow profiles such as for example rectangular profile, circular profile are suitable. Furthermore, open profiles can also be used, such as for example T-profile, L-profile, H-profile.

Practically, the respective pressure element can now be arranged on an inside of the respective housing wall facing the interior space. Here, the respective pressure element can be attached so that it is fastened to the housing only in the region of its longitudinal ends. Alternatively, an annularly closed circumferential configuration is also conceivable for the respective pressure element. Particularly practically, the respective pressure element, preferentially between its longitudinal ends, can loosely bear against the respective housing wall in a deformation region affected by the pressure-induced deformation or be spaced from the housing wall. The mode of operation of the respective pressure element thus differs in principle from the mode of operation of the tensile element described before. While the respective tensile element stiffens the housing wall affected by the deformation, in order to directly counteract the deformation of the housing wall in this way, the respective pressure element leads to a stiffening of the housing and in this way indirectly counteracts a deformation of the respective housing wall. This is based on the consideration that the deformation of the housing wall at least with certain assembly conditions is necessarily accompanied by a deformation of the housing. If the housing is now stiffened with the help of the respective pressure element, the tendency towards deformation of the respecting housing wall can be reduced accordingly.

According to a particularly advantageous embodiment, the respective pressure element can consist of a material such as for example austenite, the temperature expansion coefficient of which is greater than the temperature expansion coefficient of the material, such as for example ferrite, of which the respective housing wall consists. During the exhaust system operation, the respective exhaust system component is heated up. Here, the respective pressure element can expand more greatly than the respective housing wall, which leads to a preload that is opposite to the pressure loading. This means that the positioning of the respective pressure element is specifically effected such that thermal expansion of the pressure element leads to a stressing of the housing or of the respective housing wall that is directed opposite to the pressure-induced deformation. This effect is supported in that according to an advantageous embodiment the respective pressure element is arranged in the interior space, so that the pressure element reaches higher temperatures than the respective housing wall, which on its outside is exposed to the comparatively cold surroundings.

According to a particularly advantageous further development, the respective pressure element can be arranged in the housing so that during the operation of the exhaust system it is exposed to exhaust gas or even to an exhaust gas flow, which increases the thermal expansion of the respective pressure element.

According to another embodiment, the respective stiffening element can run between its longitudinal ends in a groove which is integrally formed on or in the respective housing wall for example by means of a bead. As a result, a positioning transversely to the longitudinal axis of the respective stiffening element is achieved in particular for elongated stiffening elements.

Furthermore, it can be provided according to an advantageous embodiment, that the respective housing wall is already pre-moulded in a deformation region affected by the pressure-induced deformation in the direction of the deformation or in the opposite direction.

According to another advantageous embodiment it can be provided that the respective stiffening element is fastened to the housing only in the region of its longitudinal ends, namely in each case in a fastening region that is not affected or less affected by the pressure-induced deformation than a deformation region affected by the pressure-induced deformation, whose deformation counteracts the respective stiffening element. Such an embodiment is suitable in particular for housings with oval or elliptical, but at any rate not circular cross section. Then, deformation regions are those circumferential sections with larger bending radii, while fastening regions are then circumferential sections with smaller bending radii.

With another advantageous embodiment it can be provided that at least one stiffening element is configured as tension-stable tensile element, which is assigned to a housing region, which during the pressure loading attempts to distance itself from a housing region located diametrically opposite.

Additionally or alternatively at least one stiffening element is configured as pressure-stable pressure element, which supports two housing regions located diametrically opposite each other on each other, which during the pressure loading attempt to approach each other. An intensive stiffening of the housing can also be realised by this in order to reduce pressure-induced deformations.

Further important features and advantageous of the invention are obtained from the subclaims, from the drawings and from the associated Figure description by means of the drawings.

It is to be understood that the features mentioned above and still to be explained in the following cannot only be used in the respective combination stated but also in other combinations or by themselves without leaving the scope of the present invention.

BRIEF DESCRIPTION OF THE DRAWINGS

Preferred exemplary embodiments of the invention are show in the drawings and are explained in more detail in the following description, wherein same reference characters refer to same or similar or functionally same components.

It shows, in each case schematically.

DETAILED DESCRIPTION OF THE INVENTION

Figure 1:
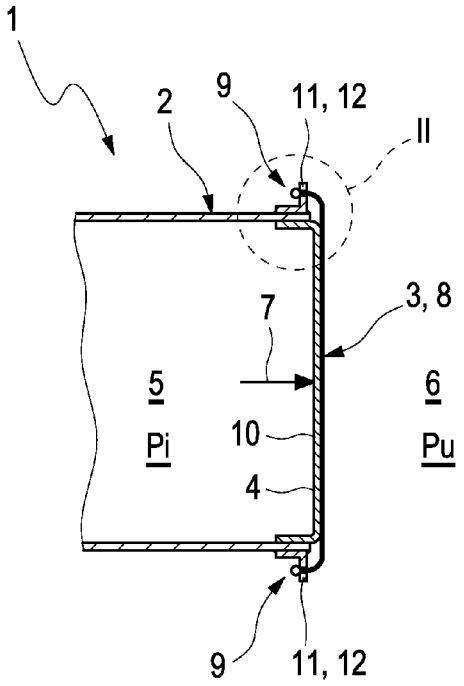
FIG. 1 a highly simplified sectional view of an exhaust system component in the region of a housing wall, FIG. 2 an enlarged detail II from FIG. 1 in the region of a holding device, FIGS. 3 to 5 front views of the housing wall with different embodiments, FIGS. 6 to 9 cross sections of the exhaust system component with different embodiments, FIG. 10 a cross section of the exhaust system component with a further embodiment according to section lines X in FIG. 11, FIG. 11 a longitudinal section of the further embodiment corresponding to section lines XI in FIG. 10.

Corresponding to FIGS. 1 to 11, an exhaust system component 1 comprises a housing 2 and at least one stiffening element 3. The exhaust system component 1, which in the following can also be called component 1, is provided for use in an exhaust system of a combustion engine, preferentially of a motor vehicle, preferentially of a commercial vehicle. The component 1 is for example a silencer or an exhaust gas treatment device such as for example a particle filter or a catalytic converter or a NOX-storage unit or a three-way catalytic converter or an SCR-system. In principle, it can also be a combination of the above devices.

The housing 2 comprises at least one housing wall 4, which separates an interior space 5 of the housing 2 from a surroundings 6 (also referred to herein as an environment) of the housing 2. During the operation of the exhaust system, an internal pressure Pi is present in the interior space 5, while in the surroundings 6 an ambient pressure Pu prevails, wherein usually the inner pressure Pi is greater than the ambient pressure Pu. Accordingly, the housing wall 4 is exposed to a pressure loading 7 indicated by an arrow. This pressure loading 7 induces a deformation of the housing wall 4. Usually, an arching of the housing wall 4 to the outside, i.e. in the direction of the surroundings 6, occurs. This deformation is now counteracted by the respective stiffening element 3. To this end, the respective stiffening element 3 is fastened to and arranged on the housing 2 in a suitable manner.

With the embodiments of FIGS. 1 to 11, the respective stiffening element 3 is configured rod-shaped or web-shaped. In particular, FIGS. 1 to 9 show a wire-shaped configuration of the stiffening element 3. However, in principle, band-shaped embodiments are also possible. A wire-shaped stiffening element 3 has a circular cross section. A band-shaped stiffening element 3 has a rectangular cross section. The stiffening elements 3 are also conceivable as singly or multiply arched shapes.

At least the embodiments of FIGS. 1 to 6 show at least one stiffening element 3, which is configured as tension-stable tensile element 8. Tensile elements 8 are for example a wire or a band or a cable. With the embodiments of FIGS. 1 to 6, the respective tensile element 8 is arranged on the outside of the respective housing wall 4 facing the surroundings 6. Because of this, the respective tensile element 3 can counteract the deformation of the housing wall 4 orientated towards the outside in a particularly effective manner.

The examples of the tensile elements 8 shown here are embodied such that the respective tensile element 8 is exclusively fastened to the housing 2 in the region of its longitudinal ends. Corresponding fastening points in this case are designated 9. Between the longitudinal ends, the tensile element 8 can loosely bear against the respective housing wall 4, namely at least in a deformation region 10 of the respective housing wall 4 affected by the pressure-induced deformation. Because of this, the assembly of the tensile elements 8 on the housing 2 is simplified. As an alternative to this, it is also possible in principle to design the respective tensile element 8 on the housing 2 in an annularly closed circumferential manner, so that the pressure forces 7 are removed within the annular tensile element 8 and are not transmitted to the housing 2.

Figure 2:
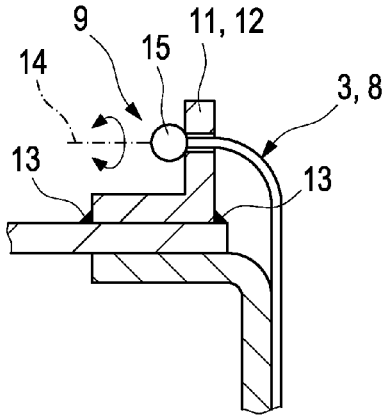
Figure 3:
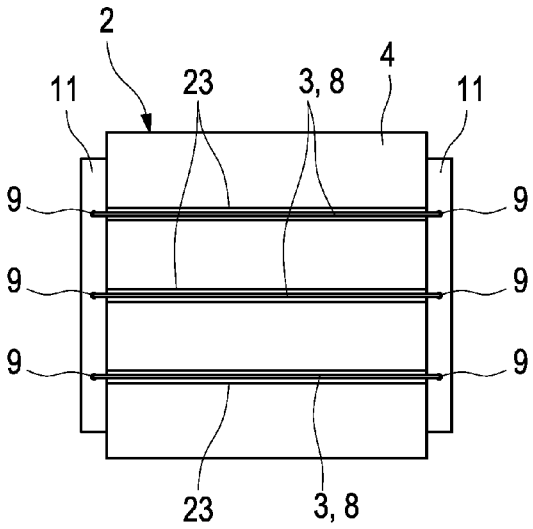
Figure 4:
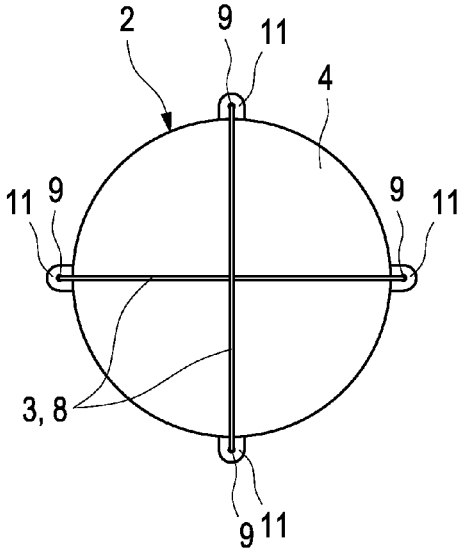
Figure 5:
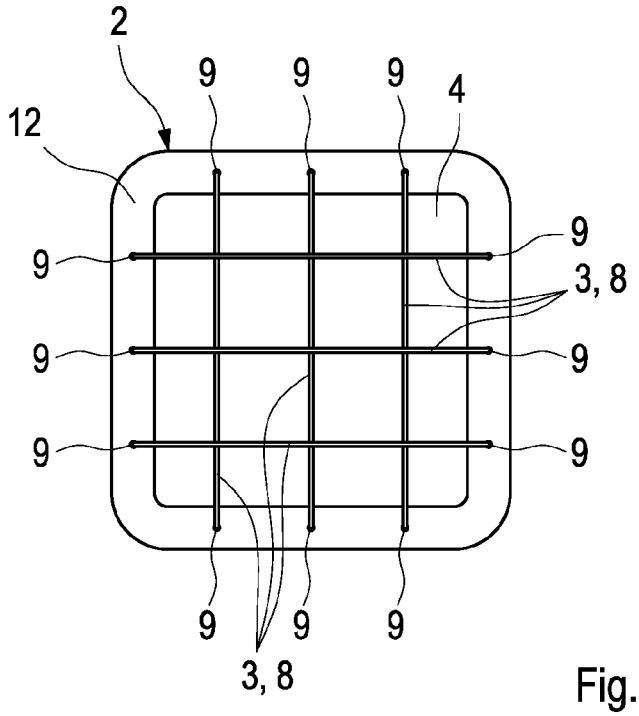

To support the pressure forces 7 received by the respective tensile element 8 on the housing 2, corresponding holders 11 or a holding frame 12 can be provided on the housing 2. The respective holder 11 or the respective holding frame 12 in this case is arranged on an outside of the housing 2 facing the surrounding 6, i.e. fastened to the housing 2 for example through weld seams 13 according to FIG. 2, and is thereby positioned outside the deformation region 10 of the housing wall 4 affected by the pressure-induced deformation. On this holder 11 or on this holding frame 12, the respective tensile element 8 can now be fixed or supported. FIG. 2 shows a special type of fixing 9, which makes possible a rotation of the tensile element 8 about a rotary axis 14, which coincides with the longitudinal axis of the tensile element 8 in the region of the fixing 9. The rotatability is realised purely exemplarily with a spherical termination element 15 of the tensile element 8.

Figure 6:
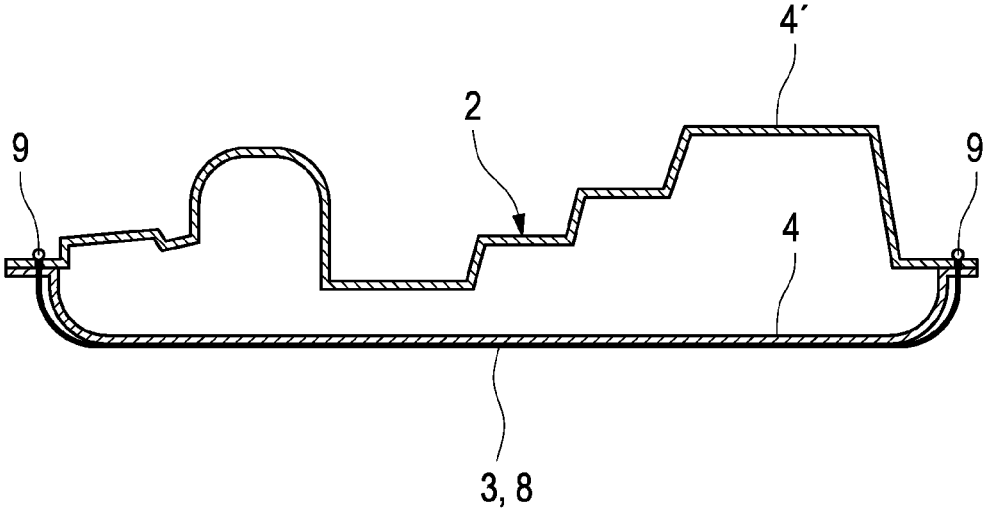

FIGS. 1 to 5 exemplarily show how with the help of the tensile elements 8 a housing wall 4 configured as end bottom can be supported from the outside in order to reduce the pressure-induced deformations. In contrast with this, FIGS. 6 to 11 show embodiments, wherein a housing wall 4 on the jacket side can be protected from a pressure-induced deformation with the help of the stiffening elements 3. Purely exemplarily, FIG. 6 shows an embodiment wherein the housing 2 is designed in a comparatively flat manner and has a dimensionally stable housing wall 4' and a flexible housing wall 4, wherein the flexible housing wall 4 is stabalised with respect to the pressure-induced deformation with the help of the at least one stiffening element 3, which is configured as tensile element 8 also in this case.

Figure 7:
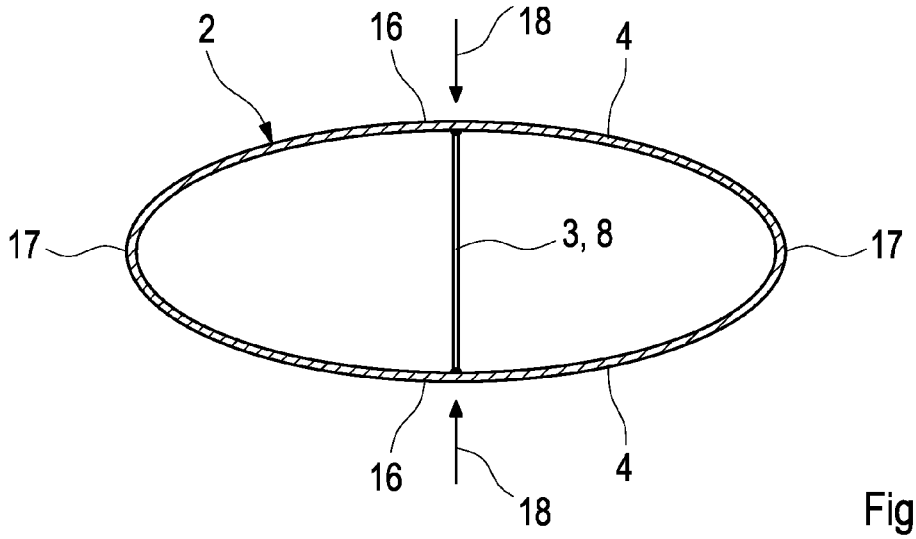
Figure 8:
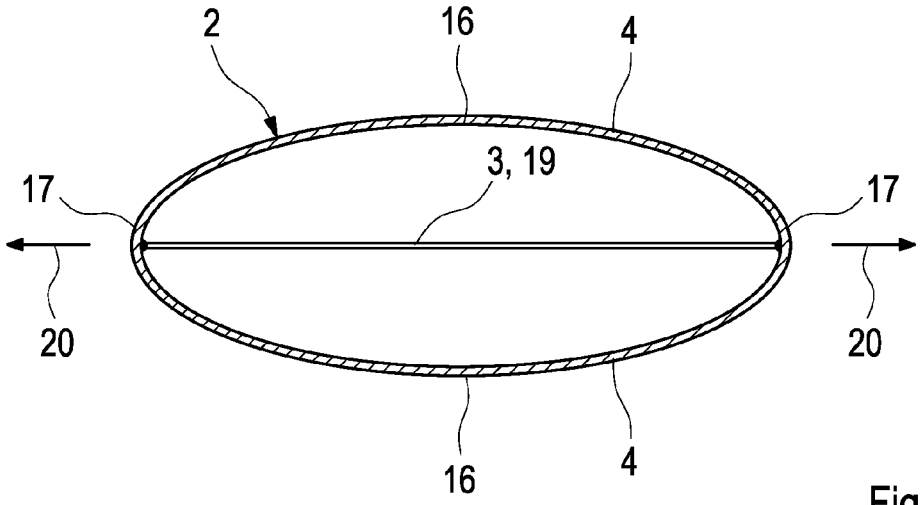
Figure 9:
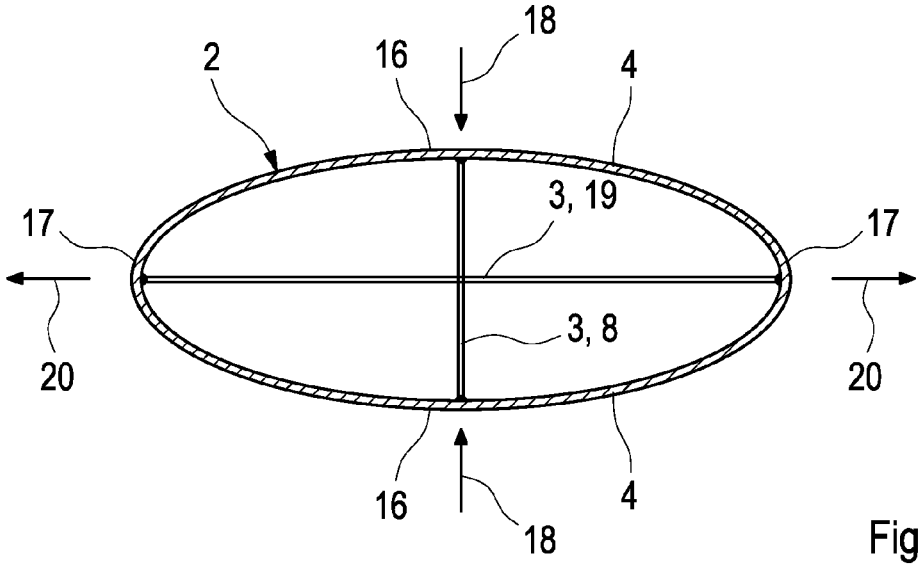

FIGS. 7 to 9 show a housing 2 with elliptical cross section. Within such an elliptical profile, housing regions 16 with larger bending radius are located diametrically opposite each other and offset by 90° thereto, housing regions 17 with smaller bending radii are likewise located diametrically opposite each other. In the case of a pressure loading of this housing 2, the housing region 16 with larger bending radius attempts to distance themselves from each other, while the housing regions 17 with smaller bending radius attempt to approach each other. In order to counteract this pressure-induced deformation, at least one stiffening element 3 is provided with the embodiment shown in FIG. 7, which is configured as tensile element 8 and which fixes the two housing regions 16 with larger bending radius on each other, thus preventing them from distancing themselves from each other during a pressure loading. Arrows 18 indicate the counterforces generated with the help of the respective tensile element 8, which counteracts the pressure-induced deformation.

With the embodiment shown in FIG. 8, at least one stiffening element 3 is configured as pressure-stable pressure element 19 and arranged in such a manner that it supports the two housing regions 17 with smaller bending radii on each other. By this it is prevented that these two housing regions 17 approach each other in the case of a pressure loading of the housing 2. The counterforces generated with the help of the pressure element 19 are indicated by arrows 20 in FIG. 8 and counteract the pressure-induced deformation of these housing regions 17.

With the embodiment shown in FIG. 9, at least one tensile element 8 according to FIG. 7 and at least one pressure element 19 according to FIG. 8 are provided in order to stiffen the housing 2. Because of this, the force path formed in the housing 2 is closed.

Figure 10:
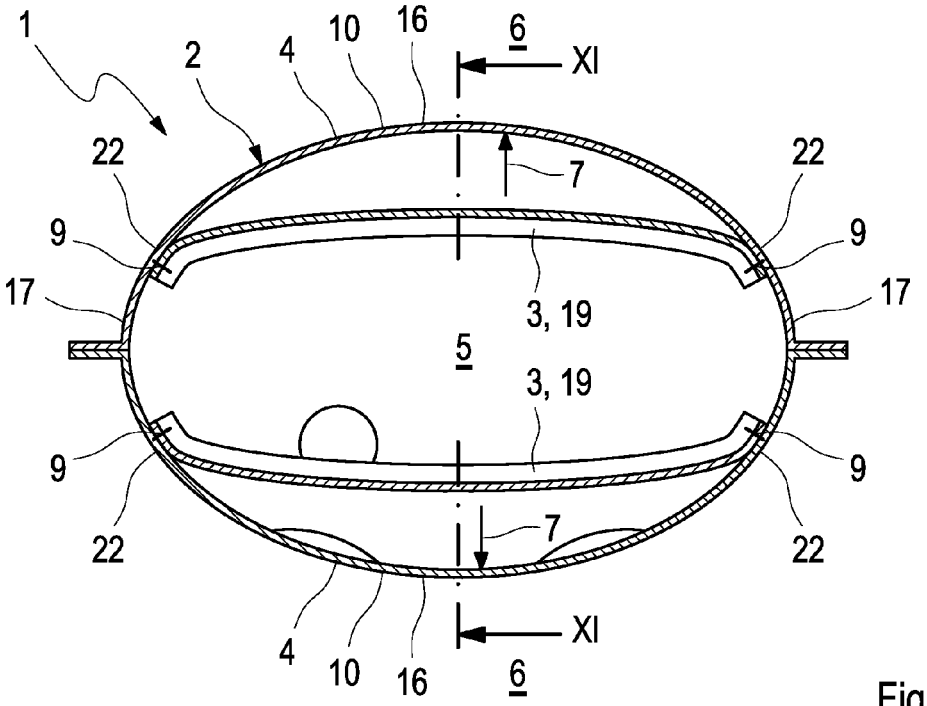
Figure 11:
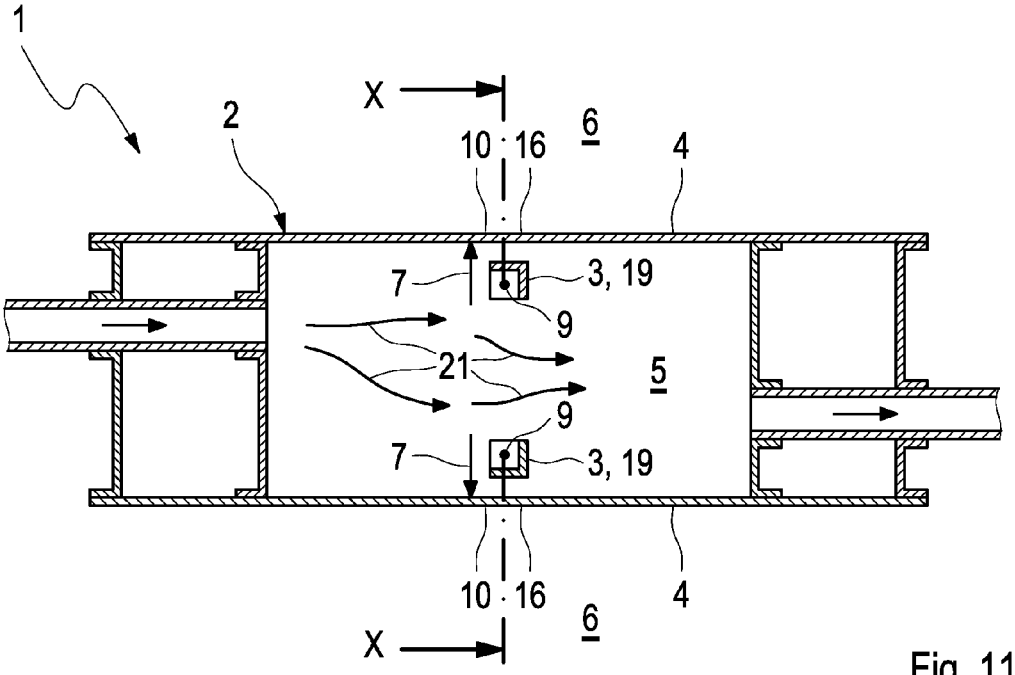

FIGS. 10 and 11 show a further embodiment, wherein at least one stiffening element 3 is configured as pressure-stable pressure element 19. Preferentially, the pressure element 19 is for example a profile member. In FIGS. 10 and 11 in this case a profile member having an L-profile is shown as pressure element 19. T-profiles or H-profiles or closed hollow profiles such as circular profiles or rectangular profiles are likewise conceivable.

Practically, the respective pressure element 19 is arranged on an inside of the respective housing wall 4 facing the interior space 5. As is evident in particular from FIG. 10, the respective pressure element 19 in this case is fastened to the housing 2 exclusively in the region of its longitudinal ends. The corresponding fastening locations in this case are again designated with 9 and can for example be formed through spot welds. Alternatively, an annularly closed circumferential configuration for the pressure elements 19 is also conceivable in principle.

The respective pressure element 19 with the embodiment shown here is positioned so that it is spaced from the housing wall 4 in the deformation region 10 affected by the pressure-induced deformation, which in the case of the elliptical housing 2 shown here coincides with the housing regions 16 with larger bending radius. It is likewise possible in principle to have the respective pressure element 19 bear loosely against the housing wall 4 in said deformation region 10. The configuration with the pressure elements 19 shown in FIG. 10 largely corresponds to the configuration shown in FIG. 8.

Particularly advantageous is an embodiment, wherein the respective pressure element 19 consists of a material whose temperature expansion coefficient is greater than the temperature expansion coefficient of the material of which the respective housing wall 4 consists. For example, the respective pressure element 19 can be produced from austenite material, while the respective housing wall 4 is produced from ferrite material. During the operation of the exhaust system, pressure element 19 and housing wall 4 are heated up. In the process, with same temperatures, the pressure element 19 expands more greatly than the housing wall 4, as a result of which the counterforces 20 of the pressure element 19, which counteracts the deformation of the housing wall 4 due to the pressure forces 7, are increased. This effect is supported in that the housing wall 4 is exposed to the surroundings 6, so that the housing wall 4 as a rule is colder than the pressure elements 19 arranged in the interior 5. Furthermore, particularly advantageous is a variant, wherein the respective pressure element 19 is positioned in the housing 2 such that it is exposed to exhaust gas or an exhaust gas flow 21 indicated by arrows in FIG. 11 during the operation of the exhaust system. Thus, the pressure elements 19 reach higher temperatures than the housing wall 4.

With the embodiment of FIGS. 10 and 11, it is noticeable in addition that the respective stiffening element 3, in this case the pressure elements 19, is fixed in the region of the longitudinal ends in each case in a fastening region 22 of the respective housing wall 4, which is not affected by the pressure-induced deformation of the housing wall 4 or less severely so than the deformation region 10. In the case of the elliptical housing 2, these fastening regions 22 correspond to the housing regions 17 with smaller bending radius.

According to an advantageous embodiment, the stiffening elements 3 arranged inside or outside can in particular run between their longitudinal ends in a groove that is integrally moulded on the respective housing wall 4, for example by means of a bead. Purely exemplarily, such a groove 23 each is indicated in this case for all embodiments in FIG. 3 for the three tensile elements 8 shown there.

Generally, it is applicable to all embodiments that the respective housing wall 4 can already be pre-moulded in a deformation region 10 in the direction of the deformation or the pressure forces 7 affected by the pressure-induced deformation. Because of this, a part of the deformation is anticipated, which increases the dimensional stability of the housing wall of the deformation region. Alternatively, it is likewise possible to pre-mould the respective housing wall 4 in the deformation region 10 affected by the pressure-induced deformation against the deformation, i.e. against the pressure forces 7. This negative pre-deformation can for example be realised with the help of the stiffening elements 3 and is preferentially realised in the region of elastic deformations. In this manner, the housing wall 4 is preloaded against the pressure loading. During the operation, the pressure loading then takes place, which initially, up to a predefined pressure, leads to an unloading of the housing wall 4, since because of this merely the preload of the housing wall 4 is used up. Through this measure, a particularly dimensionally stable structure for the housing 2 can be realised.

The invention claimed is:

1. An exhaust system component for an exhaust system of a combustion engine, in particular of a motor vehicle, comprising:

a housing having at least one housing wall, which separates an interior space of the housing exposed to an internal pressure (Pi) during the operation of the exhaust system from an environment surrounding the housing and having an ambient pressure (Pu), at least one stiffening element which is fastened to and arranged on the housing such that it counteracts a deformation of the housing wall induced by the internal pressure that is above the ambient pressure.

2. The component according to claim 1, wherein the at least one stiffening element is configured rod-shaped or web-shaped or wire-shaped or band-shaped.

3. The component according to claim 1, wherein the at least one stiffening element is configured as tension-stable tensile element, which during the operation of the exhaust system is exposed to a tensile loading.

4. The component according to claim 3, wherein the tensile element is at least one of 1)arranged on an outside of the respective housing wall facing the environment, 2)fastened to the housing only in the region of its longitudinal ends, and 3) the tensile element, in particular between its longitudinal ends, loosely bears against the housing wall in a deformation region affected by the pressure-induced deformation.

5. The component according to claim 3, wherein on the housing on an outside facing the environment one of at least one holder or at least one holding frame is arranged outside a moulding region of the housing wall affected by the pressure-induced deformation, on which the tensile element is supported.

6. The component according to claim 1, wherein the at least one stiffening element is configured as pressure-stable pressure element, which during the operation of the exhaust system is exposed to a pressure loading.

7. The component according to claim 6, wherein the pressure element is at least one of 1) arranged on an inside of the respective housing wall facing the interior space, 2) fastened to the housing only in the region of its longitudinal ends, and 3) the respective pressure element, in particular between its longitudinal ends, loosely bears against the housing wall in a deformation region affected by the pressure-induced deformation or is spaced from the housing wall.

8. The component according to claim 6, wherein the pressure element is at least one of 1) a material whose temperature expansion coefficient is greater than the temperature expansion coefficient of the material of which the housing wall consists, and 2) is arranged in the housing so that it is exposed to exhaust gas or an exhaust gas flow during the operation of the exhaust system.

9. The component according to claim 1, wherein the at least one stiffening element runs in a groove in particular between its longitudinal ends, which grooves are integrally formed on the housing wall, in particular by means of a bead.

10. The component according to claim 1, wherein the housing wall is pre-molded in a deformation region affected by the pressure-induced deformation in the direction of the deformation or against the deformation.

11. The component according to claim 1, wherein the at least one stiffening element is only fastened to the housing in the region of its longitudinal ends, namely in each case in a fastening region which is one of not affected or less affected by the pressure-induced deformation than a deformation region affected by the pressure-induced deformation, whose deformation counteracts the at least one stiffening element.

12. The component according to claim 1, wherein the at least one stiffening element is configured as at least one of 1) a tension-stable tensile element that is assigned to a housing region which during the pressure loading of the interior space attempts to distance itself from a housing region located diametrically opposite, and 2) a pressure-stable pressure element, which supports two housing regions located diametrically opposite each other on each other, which during the pressure loading of the interior space attempt to approach each other.

* * * * *